US005123349A

United States Patent [19]

Beaver et al.

[11] Patent Number: 5,123,349

[45] Date of Patent: Jun. 23, 1992

[54] SELF-INKING HAND STAMP

[75] Inventors: Thomas J. Beaver, Auburn; William A. Collins, Fort Wayne; Millard B. Beaver, Leo; Leonard L. Johnson, Huntertown, all of Ind.

[73] Assignee: Indiana Stamp Company, Inc., Fort Wayne, Ind.

[21] Appl. No.: 583,449

[22] Filed: Sep. 17, 1990

[51] Int. Cl.[5] ..... B41K 1/42

[52] U.S. Cl. ..... 101/333; 101/379; 101/406

[58] Field of Search ..... 101/103, 333, 371, 379, 101/405, 406, 368

[56] References Cited

U.S. PATENT DOCUMENTS 4,927,695 5/1990 Ooms et al. ..... 101/333 X

FOREIGN PATENT DOCUMENTS 0051578 4/1980 Japan ..... 101/379

0159388 9/1984 Japan ..... 101/333

0671807 5/1952 United Kingdom ..... 101/368

*Primary Examiner*—Edgar S. Burr

*Assistant Examiner*—Christopher A. Bennett

*Attorney, Agent, or Firm*—Pearne, Gordon, McCoy & Granger

[57] ABSTRACT

A hand stamp assembly that includes a porous ink cartridge received in the stamp housing and a porous ink containing die head that is mounted in contact with the forward face of the ink cartridge so that ink may be transferred from the cartridge to the die head as the ink in the die head is depleted. The forward face of the die head is normally protected by a spring-loaded shielding sleeve that retracts when the stamp is pressed against the surface to be marked. An axial handle socket is provided so as to receive a handle or other gripping means. The socket is designed to have an inherent resilient flexing capability to provide firm gripping of the handle or other holder.

4 Claims, 3 Drawing Sheets

SELF-INKING HAND STAMP

BACKGROUND OF THE INVENTION

This invention relates to marking devices, and more particularly to hand stamps of the type having a self-contained ink reservoir. These are often used, for example, in manufacturing processes to indicate that a particular component or assembly has been inspected at a quality control station or the like.

More particularly, the invention relates to a self-inking hand stamp that utilizes both a porous die head and an ink-containing reservoir that cooperate to continuously supply ink to the marking face of the stamp so as to provide an exceptionally high number of marking repetitions.

Prior art self-inking hand stamps currently in use often utilize a die head containing the indicia to be marked, that is formed of an open-celled microporous material capable of being saturated with a supply of liquid ink. A typical material utilized for this purpose is identified by the trade designation SP, and is manufactured and sold by Porelon, Inc., of Cookeville, Tenn. Stamps utilizing these die heads typically are capable of several thousand marking repetitions. However, after the ink supply is depleted. The stamp is generally discarded and replaced with a new device.

While these self-inking stamps are useful and generally satisfactory, the process is wasteful in that the manufacture of the die head (and the forming of the particular indicia to be marked) is generally done on a custom basis. Thus, the die heads are relatively expensive.

Also, prior art self-inking stamps are generally provided with a dedicated handle that may be suitable for some users, but which others may find awkward. For example, some workers or inspectors in manufacturing facilities may desire to place the stamp on the rearward end of a pencil or pen also used in their work.

Some prior art self-inking stamps have utilized a housing on which disposable die heads may be mounted and replaced so that the housing, handle, etc., may be used over and over with different die heads. When this is done, there is usually a retainer formed integrally with the die head that is discarded when the ink supply of the die head is depleted.

Most importantly, it is desirable in the use of stamps to obtain maximum utilization of the stamp (i.e.) a maximum number of marking cycles) in order to avoid frequent replacement and the resulting inconvenience. Self-inking stamps currently used have a limited service life, and this can have a major impact on manufacturing efficiency.

The self-inking stamp of the present invention, however, reduces the difficulties indicated above and affords other features and advantages heretofore not obtainable, including a much greater service life.

SUMMARY OF THE INVENTION

The stamp of the present invention comprises as its basic components an elongated housing having a longitudinal axis and front and rear ends with end faces generally perpendicular to the longitudinal axis. The housing defines an axial ink cartridge recess in its forward end and an axial handle socket in its rearward end. A porous ink-containing die head is seated against the forward face of the housing forwardly of and covering the cartridge recess, the die head being held in place by a retaining ring. A porous, absorbent ink cartridge is placed in the recess with an outer surface adapted to resiliently engage the rearward face of the die head so that ink may be transferred from the cartridge to the die head. As is customary, a shielding sleeve is provided coaxial with and surrounding an axial length portion of the housing, the sleeve being slidable axially between a forward position wherein the front end of the sleeve extends beyond and shields the marking face of the die head and a retracted position spaced rearwardly of the marking face. A helical spring or the like urges the shielding sleeve to its forward position.

In accordance with the invention, the axial handle socket has a longitudinal slot extending through the wall of the rearward end of the housing and extending axially the depth of the socket. Also, a lateral slot is formed through the wall of the housing adjacent the floor of the socket and extending radially through a major portion of the rearward end of the housing. The wall portions on opposite sides of the axial slot are adapted to flex slightly to provide a resilient gripping of the handle or of an alternate holding device. Accordingly, the handle socket is adapted to receive a number of different types of holders of different lateral dimensions.

DESCRIPTION OF THE PREFERRED EMBODIMENT

Figure 2:
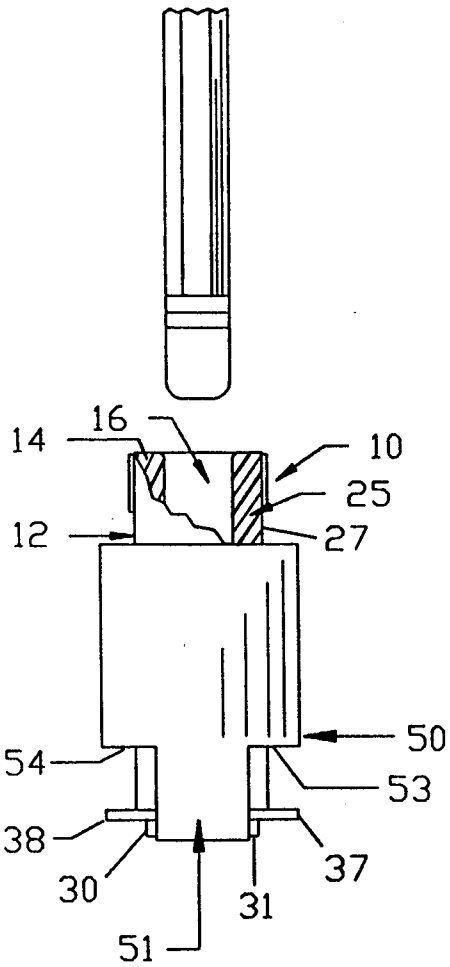
FIG. 2 is a side elevation, similar to FIG. 1, but showing the handle removed and with parts of the housing broken away to illustrate the socket portion. A pencil end is illustrated spaced from the socket, but in position to be inserted in the socket so as to provide a holding means.

Referring more particularly to the drawings, there is shown a self-inking stamp embodying the invention and including as its basic components a generally cylindrical housing 10, a die head 30 with a die retainer 35 to hold it on the housing 10, an ink cartridge 40, a shielding sleeve 50 slidably positioned on the forward end of the housing 10, and a handle 60 adapted to be removably connected to the rearward end of the housing 10. The housing 10, die retainer 35, shielding sleeve 50, and handle 60 are preferably molded from a dense thermosetting plastic material such as DELRIN.

The housing 10 has a generally cylindrical form, and includes a forward end portion 11 and a rearward end portion 12. The forward end portion 11 has a front end face 13 and the rearward end portion 12 has a rear end face 14. The front end face 13 has a cylindrical cartridge recess 15 formed therein which is adapted to receive the ink cartridge 40. The cartridge 40 comprises an open-celled microporous, cellular foam material adapted to absorb and retain a large quantity of liquid ink. The material may be, for example, a product sold under the trade designation MT by Porelon, Inc. of Cookeville, Tenn. The product, while generally rigid, is capable of some expansion as liquid ink is absorbed. Accordingly, when the cartridge is placed in the recess 15, the exposed end face bulges out somewhat to assure intimate contact with the rearward face of the die head 30.

The rearward end portion 12 is provided with an axial holder socket 16 having a unique radial cross section adapted to provide a resilient gripping effect. The unique construction of the rearward end portion 12 and the holder socket 16 will be discussed in detail below.

Figure 4:
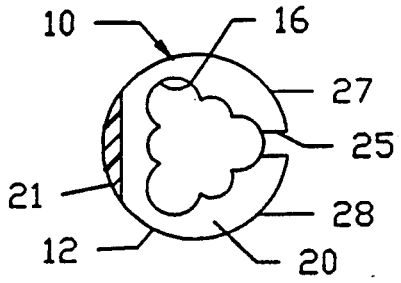
FIG. 4 is a transverse sectional view, taken on the line 4—4 of FIG. 3.
Figure 5:
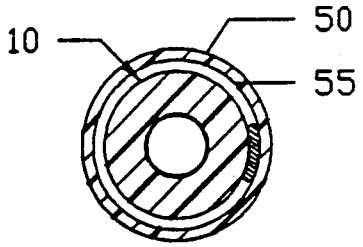
FIG. 5 is a transverse sectional view, taken on the line 5—5 of FIG. 3.
Figure 6:
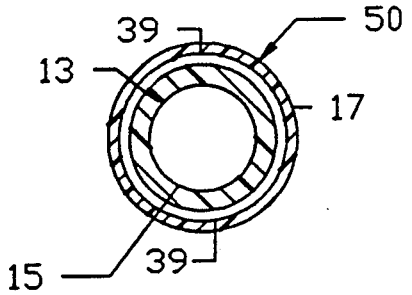
FIG. 6 is a transverse sectional view taken on the 17 line 6—6 of FIG. 3.
Figure 7:
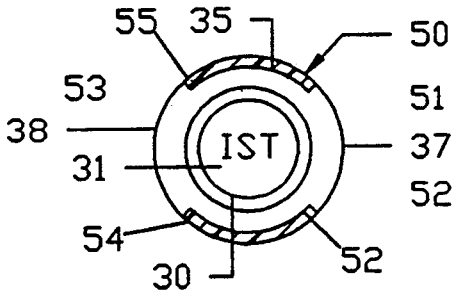
FIG. 7 is a transverse sectional view, taken on the line 7—7 of FIG. 3.

The forward end portion 11 of the housing 10 is provided with an annular shoulder or flange 17 at its forward end and an annular groove or chamfer 18 at its rearward end. A retainer ring 19 is tightly received on the forward end of the housing. The rearward end portion 12 of the housing has a transverse cut or slot 20 extending a substantial portion of the cross section and entirely through the holder socket 16. The portion left uncut provides a connecting zone 21 between the rearward end portion 12 and the front end portion 11 of the housing. An axial slot 25 extends from the rear end face 14 of the rearward end portion 12 axially to the radial slot 20. The axial slot 25 separates the side wall into outwardly flexible wall portions 27 and 28 (FIG. 4). The flexing and resiliency of the wall portions 27 and 28 serve as a gripping means to hold the handle 60 or other holding means in the socket 16.

The die head 30 is formed of an open-celled, microporous material, such as the material sold under the trade designation SP by PORELON, Inc. of Cookeville, Tenn., and is adapted to absorb and contain a quantity of liquid ink. The die head 30 includes a forward print face 31 provided with the desired indicia, and a relatively flat, rearward face 32 that engages the forward surface of the ink cartridge 40. Accordingly, as ink is depleted from the porous die head after a large number of repetitions, additional ink from the ink cartridge 40 is transferred by capillary action into the die head 30 to greatly prolong the useful life of the stamp.

The die head 30 is provided with an annular shoulder 33 facing forwardly which is adapted to be engaged by an annular die retainer 35 that has an internal annular shoulder 36 that corresponds with and mates against the annular shoulder 33 of the die head. The die retainer 35 has a pair of axial extensions 39 that are adapted to flex slightly in a radial direction, and which snap over the annular flange 17 on the housing and then contract slightly and grip the housing to retain the die head in place.

Slidably mounted over and coaxially with the forward end portion 11 of the housing 10 and over the die retainer 35 is the shielding sleeve 50. The shielding sleeve has a pair of axial extensions 51 and 52 that extend forwardly of the print face 31 so as to protect the print face from inadvertent engagement with an object when the device is not in use. The portions of the shielding sleeve between the axial extensions provide axial guide slots 53 and 54 which slidably receive radial ribs or extensions 37, 38 on the die retainer 35.

Located in an annular space between the inner surface of the shielding sleeve 50 and the outer surface of the forward end portion 11 of the housing 10 is a helical spring 55 that bears against an inwardly extending, radial flange within the shielding sleeve 50 and the retaining ring 19. Accordingly, the helical spring urges the shielding sleeve 50 to a forwardly extending position illustrated in FIGS. 1 and 3, so as to prevent inadvertent engagement of the print face of the die head with an object not intended to be marked. When, however, the stamp is positioned against an object to be marked and pressed forwardly in an axial direction, the shielding sleeve retracts against the force of the spring relative to the housing 10 (FIG. 2), and the print face of the die head moves into marking engagement with the respective surface.

Figure 1:
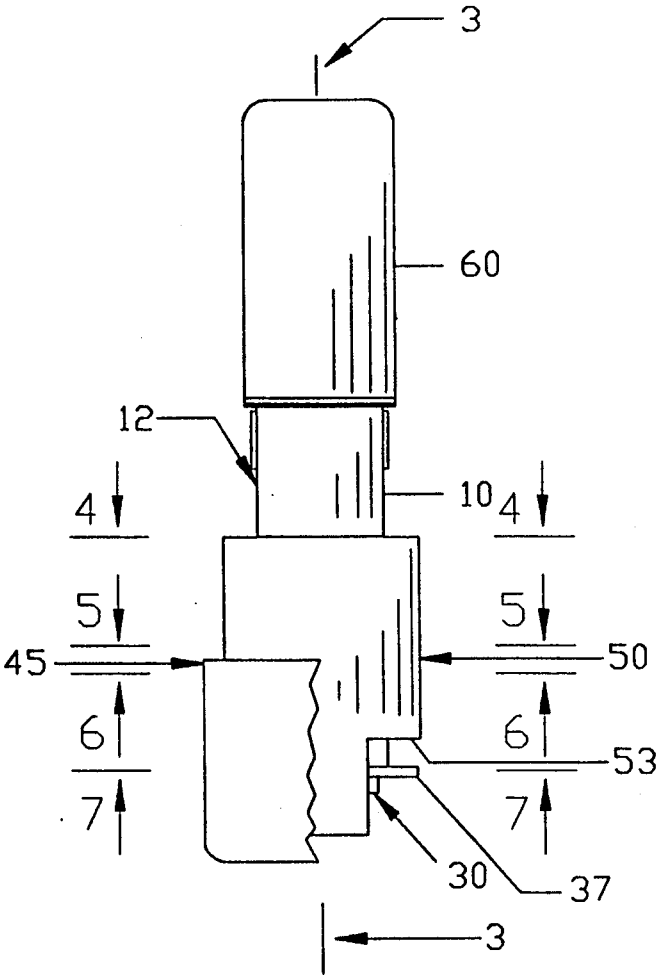
FIG. 1 is a side elevation of a self-inking stamp embodying the invention, with a portion of the die head cover broken away for the purpose of illustration.
Figure 3:
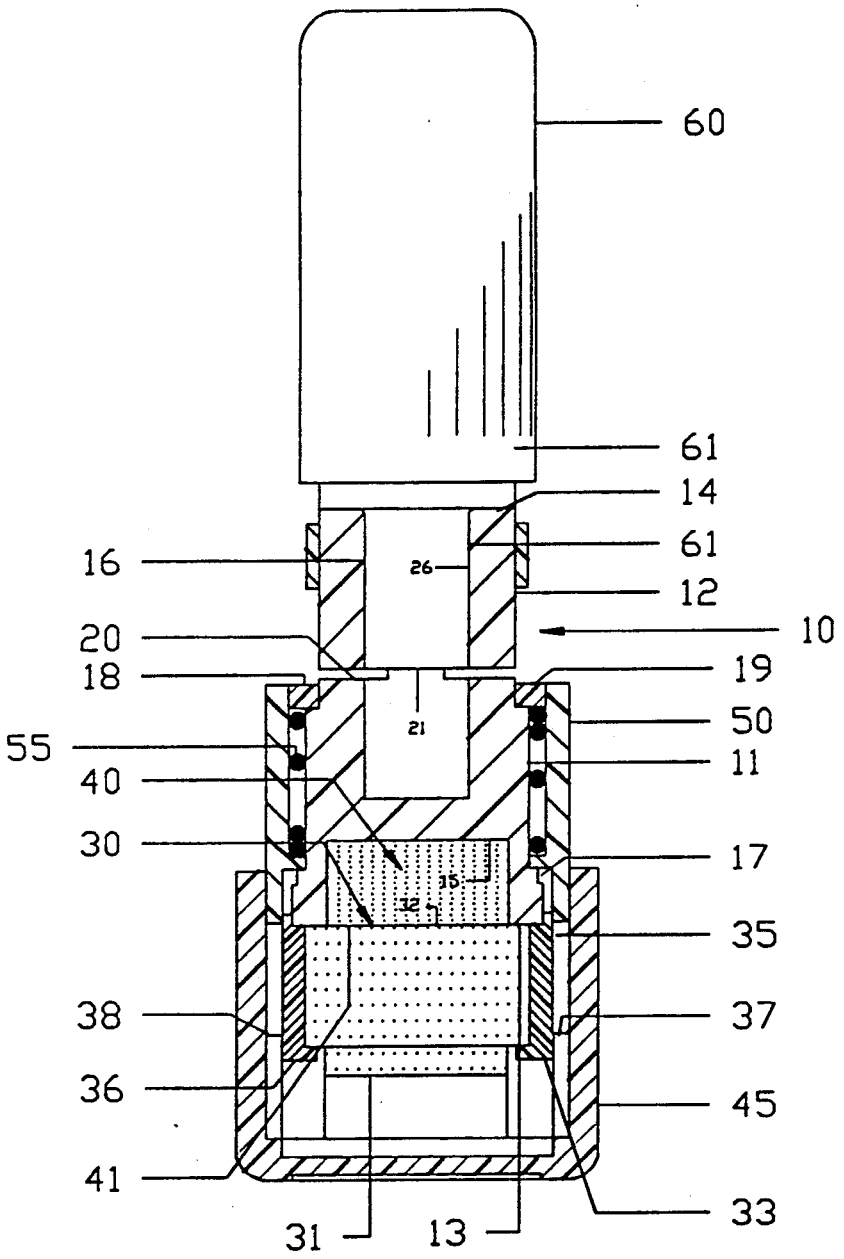
FIG. 3 is an axial section through the self-inking stamp of FIG. 1.

FIG. 2 illustrates the unique design of the socket 16 in the rearward end portion of the housing 10, and, as indicated, a holding device other than the dedicated holder illustrated in FIGS. 1 and 3 may be used to support the stamp in a manner that might particularly suit the user. In the particular socket construction indicated, the socket is formed with three axially extending, symmetrical bores that are symmetrical about the central axis of the housing. The three bores thus formed are then joined by forming a central axial bore that connects them together (FIG. 4). This arrangement essentially defines six gripping edges that engage the particular portion of the holder or other device.

Because of the unique cooperation between the radial slot 20 and the axial slot 25, considerable resiliency is provided as to the gripping function of the socket. Accordingly, significant variation in the diameter of the stem or post, or the like, on which the stamp is to be supported is obtained with this construction. A metal reinforcing ring or band may be provided around the rearward end portion 16 of the housing 10, if desired to limit flexing.

In the operation of the stamp shown and described, a pumping action is produced each time a mark is made. This is because the pressing of the stamp against a rigid surface to be marked causes a slight resilient compression of the porous die head 30 and slightly increases the pressure of the rearward face of the die head against the forward face of the ink cartridge. The result is that there is a continuous contact, and even progressive transfer, of liquid ink from the ink cartridge to the porous die head.

In order to obtain optimum advantage of this pumping action, it is important to have close dimensional tolerances in the porous ink cartridge 40 and the cartridge recess 15. A close fit is necessary in order to prevent radial expansion of the cartridge 40. Also, the axial depth of the recess 15 should be slightly less than the axial length of the cartridge 40 to assure that the cartridge protrudes beyond the end face 13 of the housing 10.

It has been found that a self-inking stamp embodying the present invention can produce as many as 150,000 marking cycles before the ink supply is depleted. The number of cycles that can be performed will," of course, depend upon the surface area of the indicia that is formed on the forward face of the die head and on the nature of the surface on which the mark is to be made.

With the unique arrangement of the invention, the die head 30 need not be discarded when the ink supply is depleted. On the contrary the die head is temporarily removed by removing the retainer ring 35 and placing a new ink cartridge 40 in the cartridge recess 15. Then the die head and retainer ring are replaced on the housing and after a sufficient time, the ink in the die head will be replenished with ink from the ink cartridge. The die head and the retainer ring can easily be replaced as well.

As indicated above, the preferred material for use in forming the die head 30 is an open-celled, microporous, plastic material sold under the trade designation "SP" by Porelon, Inc., of Cookeville, Tenn. While this material is suitable, other types of microporous plastics may, of course, be used in accordance with the invention.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A self-inking stamp assembly comprising:

an elongated unitary housing having a longitudinal axis and front and rear end faces, said housing defining an axial cartridge recess in its front end face and an axial holder socket in its rear end face;

a porous ink-containing die head seated against the front end face of said housing and over said cartridge recess;

means for removably retaining said die head on said housing;

a porous, absorbent, compressible ink cartridge adapted to be placed in said recess with an outer surface adapted to resiliently engage the rearward face of said die head whereby ink may be transferred from said cartridge to said die head;

a shielding sleeve coaxial with and surrounding an axial length portion of said housing, said sleeve being slidable axially between a forward position wherein the front end of said sleeve extends beyond and shields the marking face of said die head, and a retracted position spaced rearwardly of said marking face;

resilient means urging said sleeve toward said forward position;

said axial holder socket being resiliently radially expansible and adapted to selectively receive therein cooperating holder portions of different lateral dimensions.

2. A self-inking stamp assembly as defined in claim 1, wherein said ink cartridge is formed of a moldable microporous plastic material.

3. A self-inking stamp assembly as defined in claim 1, wherein said axial holder socket has a longitudinal cut extending through the wall of said housing rear end and extending axially the depth of said socket, and a radial cut through said wall of said housing rear end extending through a major portion of the rear end of said housing and intersecting said longitudinal cut.

4. A self-inking stamp assembly as defined in claim 3, wherein said socket is formed of a central axial bore and at least three symmetrically spaced eccentric bores with axes parallel to said central axis.

* * * * *